US006884132B2

(12) United States Patent
Okabe

(10) Patent No.: US 6,884,132 B2
(45) Date of Patent: Apr. 26, 2005

(54) OUTBOARD MOTOR WITH HANDLE BAR

(75) Inventor: Yoshihiko Okabe, Hamamatsu (JP)

(73) Assignee: Yamaha Marine Kabushiki Kaisha Co., Ltd., Shizuoka (JP)

( * ) Notice: Subject to any disclaimer, the term of this patent is extended or adjusted under 35 U.S.C. 154(b) by 0 days.

(21) Appl. No.: 10/732,128

(22) Filed: Dec. 10, 2003

(65) Prior Publication Data

US 2004/0121667 A1 Jun. 24, 2004

(30) Foreign Application Priority Data

Dec. 11, 2002 (JP) ..... 2002-358904
Dec. 11, 2002 (JP) ..... 2002-358912

(51) Int. Cl.[7] ..... B60K 41/00
(52) U.S. Cl. ..... 440/87; 440/84
(58) Field of Search ..... 440/75, 84, 86, 440/87

(56) References Cited

U.S. PATENT DOCUMENTS 4,191,866 A 3/1980 Nakajima et al. ..... 200/4
4,241,687 A * 12/1980 DuBois et al. ..... 440/63
4,549,869 A 10/1985 Iida et al. ..... 440/84
5,230,643 A 7/1993 Kanno ..... 440/86
5,575,698 A 11/1996 Ogino ..... 440/75

FOREIGN PATENT DOCUMENTS

JP 11-034986 2/1999
JP 11-208589 8/1999

* cited by examiner

*Primary Examiner*—Jesus D. Sotelo
(74) *Attorney, Agent, or Firm*—Knobbe, Martens, Olson & Bear LLP

(57) ABSTRACT

An outboard motor has a drive unit and a bracket assembly mounted on an associated watercraft to carry the drive unit. The drive unit has a steering shaft supported by the bracket assembly for pivotal movement about a steering axis that extends generally vertically. An engine of the outboard motor has throttle valves that regulate an amount of air to combustion chambers of the engine. A handle bar extends from the steering shaft. The handle bar includes a throttle valve control grip disposed at an end portion of the handle bar for pivotal movement about an axis of the handle bar. The control grip is connected to the throttle valves to operate the throttle valves. A lock mechanism can inhibit the control grip from rotating. The lock mechanism is positioned at a terminal end of the end portion.

22 Claims, 13 Drawing Sheets

OUTBOARD MOTOR WITH HANDLE BAR

PRIORITY INFORMATION

The present application is based on and claims priority under 35 U.S.C. § 119 to Japanese Patent Applications No. 2002-358904, filed on Dec. 11, 2002, and No. 2002-358912, filed on Dec. 11, 2002, the entire contents of which are expressly incorporated by reference herein.

BACKGROUND OF THE INVENTION

1. Field of the Invention

The present invention generally relates to an outboard motor with a handle bar, and more particularly relates to an outboard motor having a handle bar that incorporates an operating member thereon.

2. Description of Related Art

Watercrafts can have one or more outboard motors disposed at a stern thereof. The outboard motors typically have a drive unit and a bracket assembly. The bracket assembly is mounted on an associated watercraft to carry the drive unit for pivotal movement about a steering axis. Typically, a steering shaft coupled with the drive unit defining the steering axis extends vertically through the bracket assembly. The drive unit thus is steerable relative to the watercraft.

The drive unit incorporates a propulsion device that propels the watercraft. The propulsion device typically is a propeller. A transmission couples the propulsion device with a prime mover that powers the propulsion device. Typically, the prime mover is an engine. The engine has a throttle valve that regulates an amount of air that is delivered to a combustion chamber of the engine. Normally, output power of the engine varies depending on the amount of the air.

Typically, a power switch is provided to start supplying electric power to electrical components of the engine and other electrical equipment of the outboard motor and/or the watercraft. A stop switch unit also is provided to the outboard motor. An operator of the outboard motor can immediately stop the operation of the engine without handling the power switch.

A shift mechanism also is incorporated in the drive unit to move the transmission among forward, reverse and neutral positions that correspond to forward, reverse and neutral modes of the propulsion device, respectively. The propulsion device can propel the watercraft forwardly when the transmission is set in the forward position, while the propulsion device can propel the watercraft backwardly when the transmission is set in the reverse position. The propulsion device does not propel the watercraft when the transmission is set in the neutral position because the propulsion device is disconnected from the prime mover in this position.

With reference to FIGS. 1 and 2, conventionally, a bracket assembly 20 supports a drive unit 22 of an outboard motor 22 on an associated watercraft 24 as noted above. A handle bar 26 extends from a steering shaft 28 such that an operator of the outboard motor 22 can steer the drive unit 22. A throttle valve control grip 30 is disposed at an end portion of the handle bar 26. The operator can operate the throttle valve with the throttle valve control grip 30. A shift lever 32 is disposed on the handle bar 26 for the operator to operate the shift mechanism. A stop switch unit 34 (FIG. 2) also is disposed on the handle bar 26. Further, a lock member 36 is provided on the handle bar 26 to lock the control grip 30 at a certain angular position. The lock member 36 is positioned on a side surface of the handle bar 26.

Such a conventional arrangement of the handle bar is disclosed in, for example, JP 11-34986 and JP 11-208599.

Normally, the operator sits on the starboard side relative to the handle bar and operates the throttle valve control grip by his or her left hand. Due to the position of the lock member in the conventional arrangements, the operator should often detach his or her hand from the throttle valve control grip to operate the lock member.

SUMMARY OF THE INVENTION

An aspect of the present invention involves the recognition of the need for an outboard motor with an improved handle bar that can provide easiness for operating a lock mechanism of an operating member that can include the throttle valve control grip.

To address such a need, an aspect of the present invention involves an outboard motor that comprises a drive unit and a bracket assembly adapted to be mounted on an associated watercraft to carry the drive unit. The drive unit comprises a steering shaft supported by the bracket assembly for pivotal movement about a steering axis that extends generally vertically. A prime mover is provided. A regulating device is configured to regulate output of the prime mover. A handle bar extends from the steering shaft. The handle bar comprises an operating member disposed at an end portion of the handle bar for pivotal movement about an axis of the handle bar. The operating member is connected to the regulating device to operate the regulating device. A lock mechanism is arranged to inhibit the operating member from rotating. The lock mechanism is positioned at a terminal end of the end portion.

In accordance with another aspect of the present invention, an outboard motor comprises a drive unit and a bracket assembly adapted to be mounted on an associated watercraft to carry the drive unit. The drive unit comprises a steering shaft supported by the bracket assembly for pivotal movement about a steering axis that extends generally vertically. A prime mover is provided. A regulating device is configured to regulate output of the prime mover. A handle bar extends from the steering shaft. The handle bar comprises an operating member disposed at an end portion of the handle bar for pivotal movement about an axis of the handle bar. The operating member is connected to the regulating device to operate the regulating device. A lock unit is arranged to provide friction between the housing and the operating member. The lock unit includes a lock member disposed at a terminal end of the end portion.

In accordance with a further aspect of the present invention, an outboard motor comprises a drive unit and a bracket assembly adapted to be mounted on an associated watercraft to carry the drive unit. The drive unit comprises a steering shaft supported by the bracket assembly for pivotal movement about a steering axis that extends generally vertically. A prime mover is provided. A regulating device is configured to regulate output of the prime mover. A handle bar extends from the steering shaft. The handle bar comprises an operating member disposed at an end portion of the handle bar for pivotal movement about an axis of the handle bar. The operating member is connected to the regulating device to operate the regulating device. Means are provided for inhibiting the operating member from rotating and are disposed at a terminal end of the end portion.

In accordance with a still further aspect of the present invention, a method is provided for controlling an outboard motor that has a drive unit including a prime mover. The method comprises regulating output of the prime mover by an operating member that is disposed at an end portion of a handle bar, and inhibiting the operating member from rotating by a lock mechanism that is disposed at a terminal end of the end portion while not regulating output of the prime mover.

BRIEF DESCRIPTION OF THE DRAWINGS

These and other features, aspects and advantages of the present invention are now described with reference to the drawings of a preferred embodiment, which embodiment is intended to illustrate and not to limit the present invention, in which.

DETAILED DESCRIPTION OF THE PREFERRED EMBODIMENT OF THE INVENTION

Figure 1:
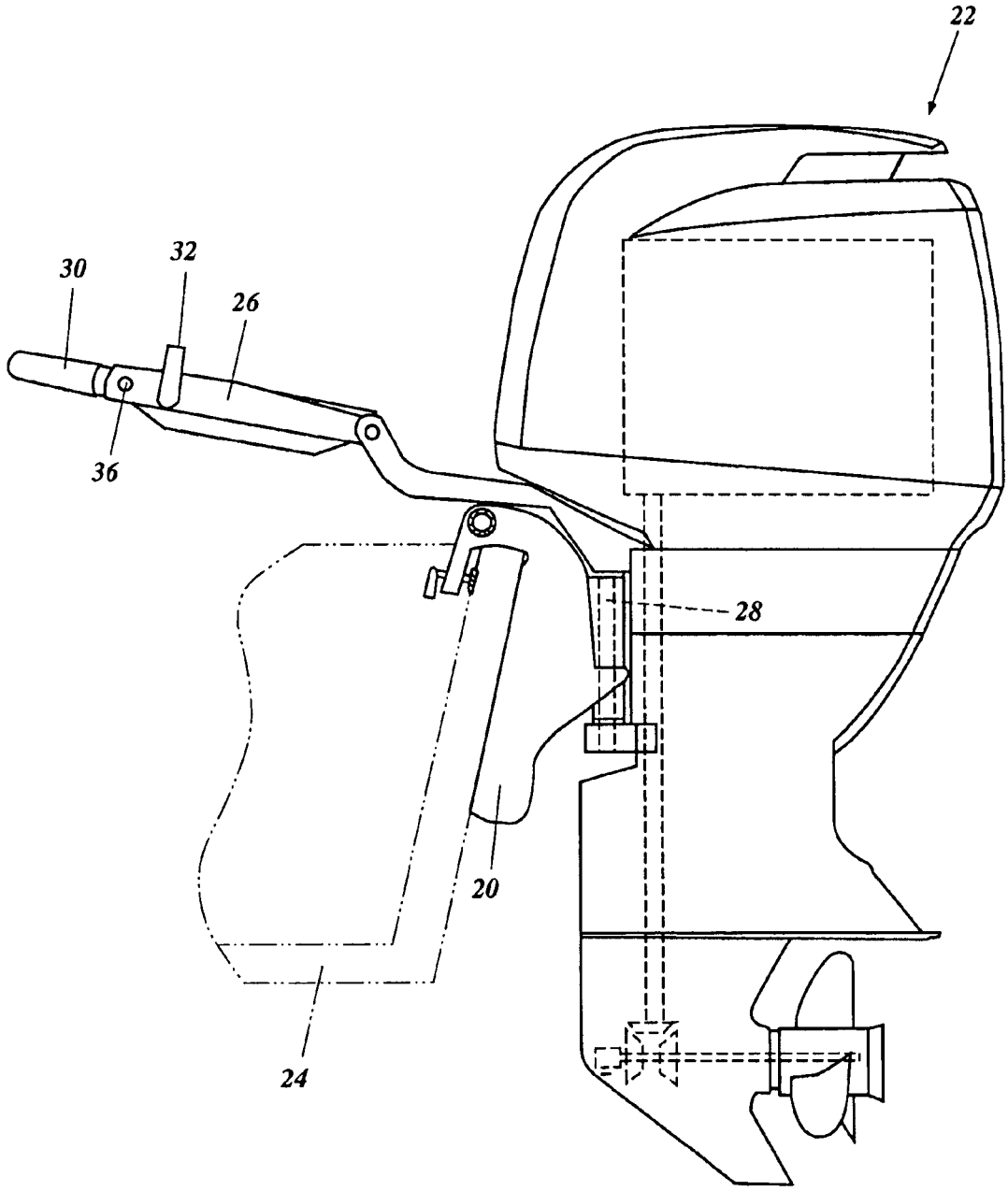
Figure 1 Prior Art
FIG. 1 illustrates a side elevational view of a conventional outboard motor and FIG. 2 illustrates a top plan view of the outboard motor of FIG. 1, these figures being provided to assist in understanding the conventional arrangement and comparing the aspects, features and advantages associated with the present invention.
Figure 2:
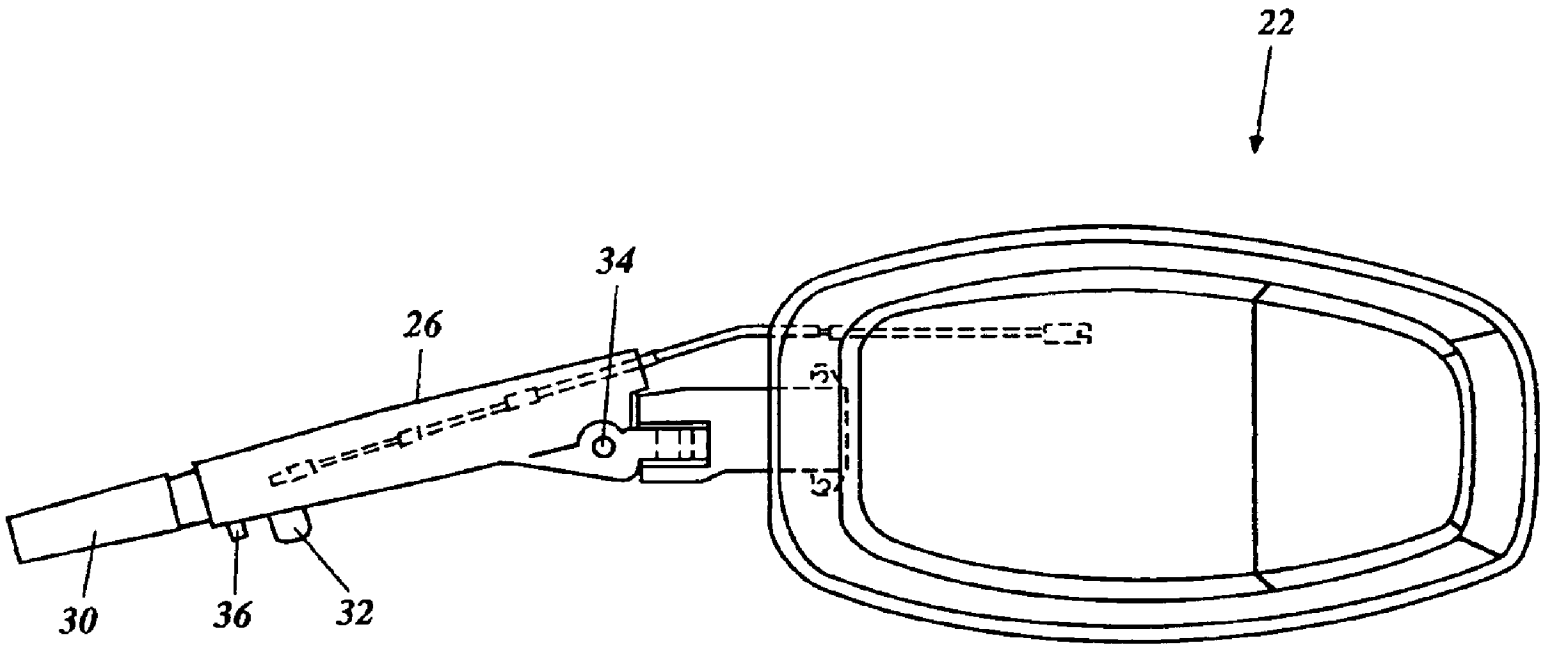
Figure 2 Prior Art
Figure 3:
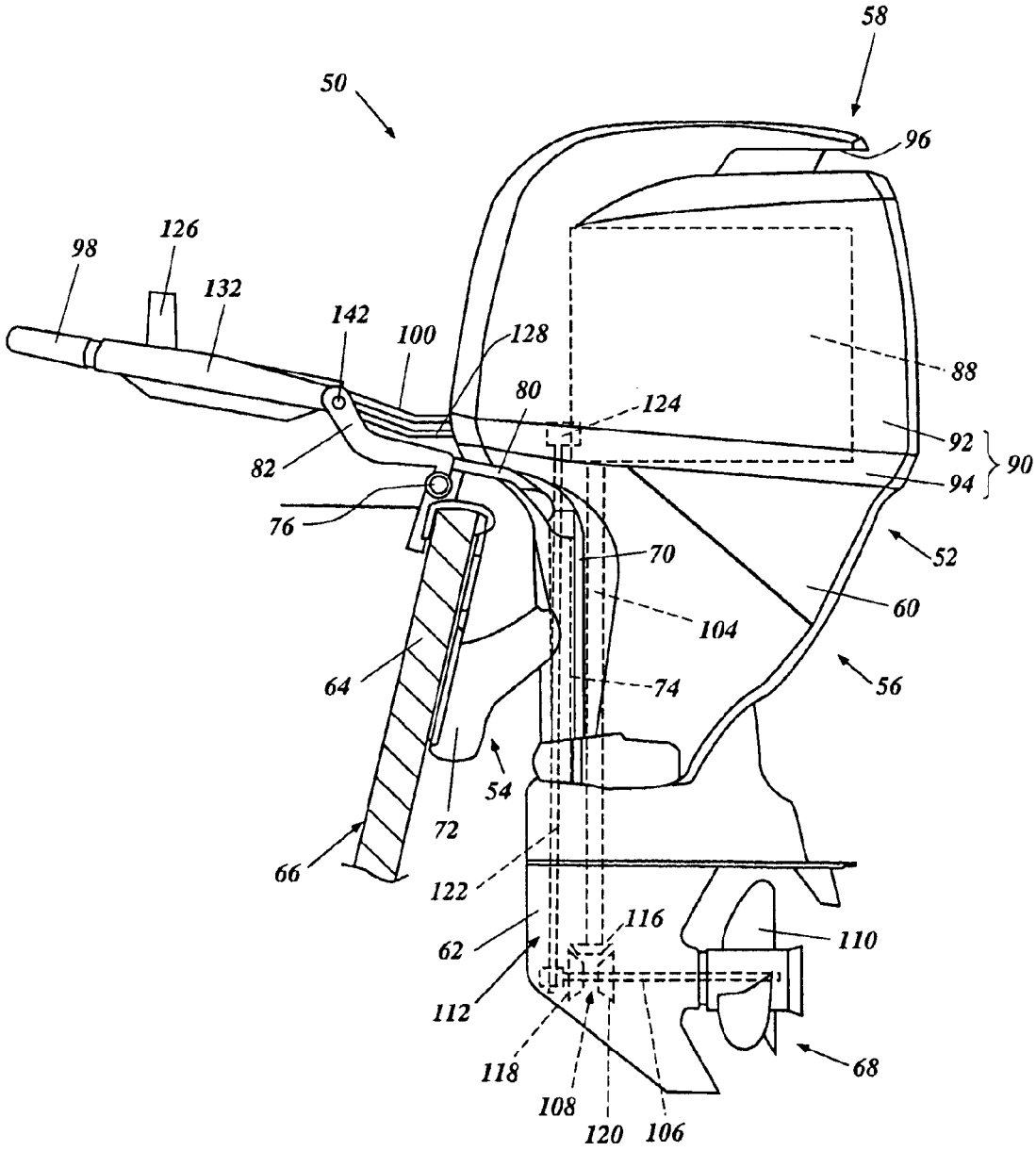
FIG. 3 illustrates a side elevational view of an outboard motor on the port side, the outboard motor configured in accordance with certain features, aspects and advantages of the present invention, a rear portion of an associated watercraft also shown.
Figure 4:
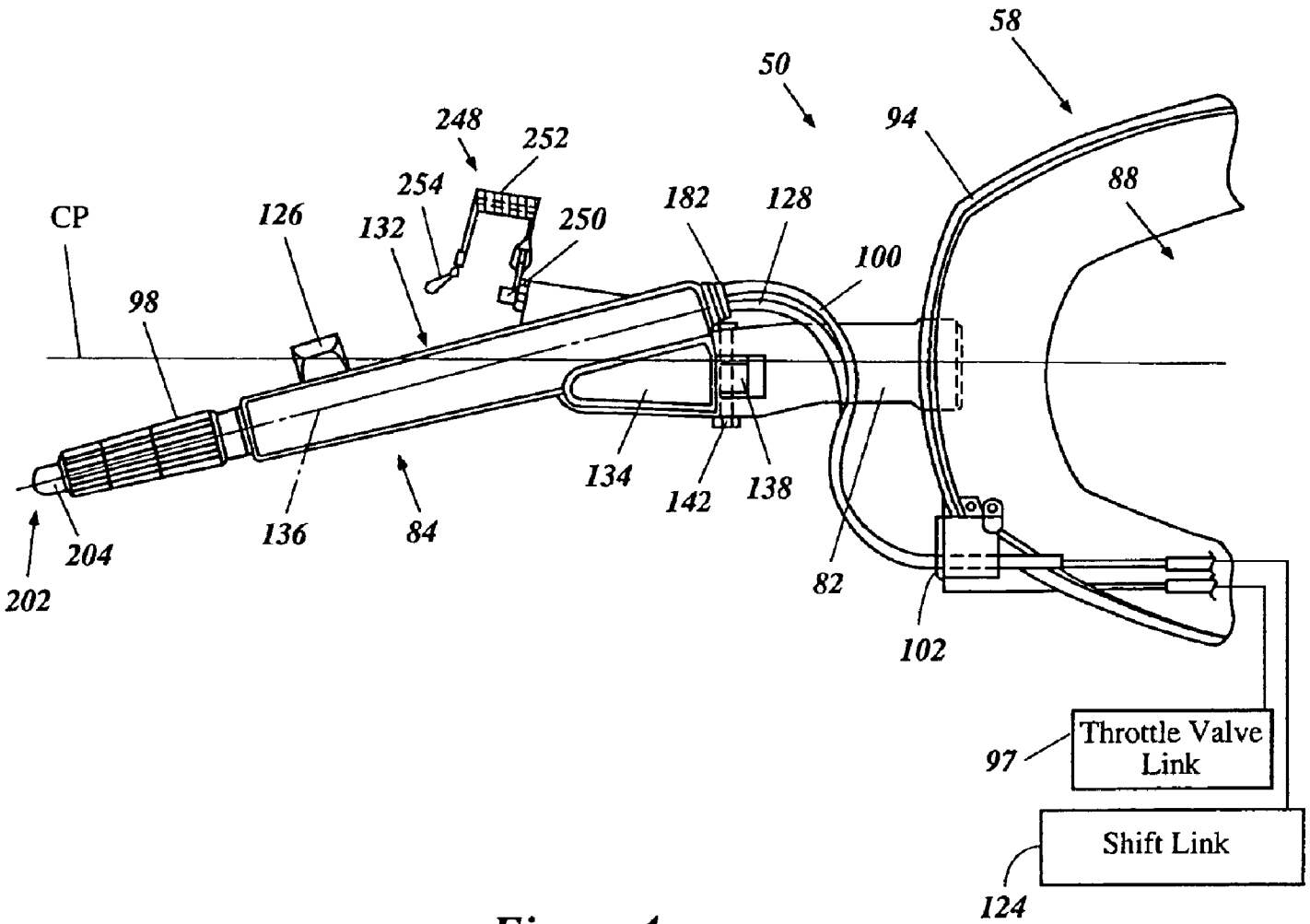
FIG. 4 illustrates a top plan view of a handle bar extending from a drive unit of the outboard motor of FIG. 3.

With reference to FIGS. 3 and 4, an overall construction of an outboard motor 50 configured in accordance with certain features, aspects and advantages of the present invention is described.

The outboard motor 50 preferably comprises a drive unit 52 and a bracket assembly 54. The drive unit 52 preferably comprises a housing unit 56 and a power head 58 disposed atop the drive unit 52 and above the housing unit 56. The housing unit 56 in the illustrated embodiment comprises a driveshaft housing 60 and a lower unit 62. The bracket assembly 54 supports the drive unit 52 on a transom 64 of an associated watercraft 66 and places a marine propulsion device 68 in a submerged position with the watercraft 66 resting on the surface of a body of water.

As used through this description, the terms "forward," "forwardly" and "front" mean at or to the side where the bracket assembly 54 is located, and the terms "rear," "reverse," "backwardly" and "rearwardly" mean at or to the opposite side of the front side, unless indicated otherwise or otherwise readily apparent from the context use.

The bracket assembly 54 preferably comprises a swivel bracket 70, a clamping bracket 72, a steering shaft 74 and a pivot pin 76. The steering shaft 74 preferably extends generally vertically through the swivel bracket 70 and is affixed to the housing unit 56 through upper and lower mount assemblies. The steering shaft 74 is pivotally journaled within the swivel bracket 70 for steering movement about a steering axis defined by the steering shaft 74. The steering axis extends vertically along a center plane CP (FIG. 4) that extends vertically and fore to aft relative to the outboard motor 50. Because the steering shaft 74 is affixed to the housing unit 56, the drive unit 52 pivots about the steering axis relative to the swivel bracket 70. Preferably, a steering lever 80 extends generally upward and forward from a top end of the steering shaft 74. A steering bracket 82 is affixed to the steering lever 80 and further extends generally forward. A handle bar 84 is affixed to a forward end of the steering bracket 82. The drive unit 52 is steerable about the axis of the steering shaft 74 when a human operator of the outboard motor 50 moves the handle bar right and left. The handle bar 84 will be described in greater detail below.

The clamping bracket 72 comprises a pair of bracket arms that are spaced from each other and are affixed to the watercraft transom 64. The pivot pin 76 extends generally horizontally and completes a hinge coupling between the swivel bracket 70 and the clamping bracket 72. The pivot pin 76 extends through the bracket arms such that the clamping bracket 72 supports the swivel bracket 70 for pivotal movement about a tilt axis defined by the pivot pin 76. The drive unit 52 together with the swivel bracket 70 thus can be tilted or trimmed about the pivot pin 76 relative to the clamping bracket 72.

As used in this description, the term "horizontally" means that the subject portions, members or components extend generally in parallel to the water surface when the watercraft 66 is substantially stationary with respect to the water surface and when the drive unit 52 is not tilted and is generally placed in the position shown in FIG. 3. The term "vertically" in turn means that portions, members or components extend generally normal to those that extend horizontally.

A tilt and trim adjustment device (not shown) preferably is provided between the swivel bracket 70 and the clamping bracket 72 to tilt (raise or lower) the swivel bracket 70 together with the drive unit 52 relative to the clamping bracket 72. The tilt and trim adjustment device preferably comprises a hydraulically operated mechanism that includes a hydraulic cylinder, a hydraulic piston reciprocating within the cylinder and a hydraulic pump that powers the piston. A piston rod extends outward beyond one end of the cylinder. Preferably, a bottom end of the cylinder is pivotally affixed to the clamping bracket 72 while a top end of the piston rod is pivotally affixed to the swivel bracket 70.

The tilt and trim adjustment device also comprises a tilt actuator that is coupled with a housing of the hydraulic mechanism to actuate the hydraulic pump. The tilt actuator preferably is an electric motor that rotates in a right direction and a reversed direction. When the electric motor is activated, the hydraulic pump operates and the piston rod extends from the cylinder or retracts into the cylinder. With the extending movement of the piston rod, the swivel bracket 70 with the drive unit 52 is tilted up. With the retracting movement of the piston rod, the swivel bracket 70 with the drive unit 52 is tilted down.

Preferably, the drive unit 52 moves between a fully tilted down position that is the most lowered position of the drive unit 52 and a fully tilted up position that is the most raised position of the drive unit 52 when the tilt and trim adjustment device is activated. Preferably, a lower tilt range is a trim adjustment range.

Normally, the propulsion device 68 is submerged while the drive unit 52 moves during the trim adjustment range. A position of the watercraft 66 varies in accordance with a trim adjustment position when the propulsion device is powered. A higher trim adjustment position is suitable for a high speed running of the watercraft 66 because a bow portion of the watercraft 66 can be slightly lifted up by the thrust force of the propulsion device 68 and the watercraft 66 can easily transfer to a planing state. On the other hand, a lower trim adjustment position is suitable for a low speed running that includes a troll running and also for accelerating the running speed. The propulsion device 68 can be out of the water while the drive unit 52 moves during the tilt range. Thus, the drive unit 52 is placed in a tilt position when the operator or user wants to keep the drive unit 52 out of the water.

The power head 58 comprises a prime mover, which in this embodiment is an internal combustion engine 88. Other prime movers such as, for example, an electric motor can replace the engine 88. The power head 58 further comprises a protective cowling assembly 90. Preferably, the protective cowling assembly 90 defines a generally closed cavity and the engine 88 is disposed within the protective cowling assembly 90. The protective cowling assembly 90 preferably comprises a top cowling member 92 and a bottom cowling member 94. The top cowling member 92 preferably is detachably affixed to the bottom cowling member 94 by a coupling mechanism so that a user, operator, mechanic or repair person can access the engine 88 for maintenance or for other purposes.

The top cowling member 92 preferably has an air intake opening 96 through which ambient air is drawn into the cavity of the protective cowling assembly 90. The intake opening 96 preferably is formed at a rear and upper portion of the top cowling member 92. Typically, the top cowling member 92 tapers in girth toward its top surface, which is in the general proximity of the air intake opening.

The bottom cowling member 94 preferably has an opening at its lowermost portion through which an uppermost portion of the housing unit 56 extends. The bottom cowling member 94 and the uppermost portion of the housing unit 56 together form a tray. The engine 88 is placed onto this tray and is affixed to the housing unit 56. The engine 88 thus is positioned generally atop the drive unit 52.

The engine 88 preferably is a four-cylinder, four-cycle engine and comprises a cylinder block that defines cylinder bores extending horizontally and spaced vertically from each other. Pistons are reciprocally disposed in the cylinder bores. A cylinder head is affixed to one end of the cylinder block. The cylinder bores, the pistons and the cylinder head together define combustion chambers.

A crankcase member is affixed to another end of the cylinder block to define a crankcase chamber therebetween. A crankshaft preferably is journaled between the cylinder block and the crankcase member. The crankshaft is coupled with the pistons through connecting rods and rotates with the reciprocal movement of the pistons.

The engine 88 preferably has one or more camshafts extending generally vertically and journaled on the cylinder head. The camshafts preferably actuate intake and exhaust valves. The crankshaft preferably has a drive pulley or sprocket while the camshafts have driven pulleys or sprockets. An endless transmitter such as, for example, a timing belt or timing chain is wound around the pulleys or sprockets. Thus, the crankshaft drives the camshafts through the transmitter.

An air intake device preferably is provided to draw the air in the cavity and to deliver the air to the combustion chambers. The intake valves are part of the intake device and allow the air to go into the combustion chambers when the intake valves do not close intake ports of the combustion chambers. The intake device preferably has a regulating device that regulates output of the engine 88. In the illustrated embodiment, the regulating device is a throttle valve unit that comprises four throttle valves. Each throttle valve preferably is a butterfly type valve and is disposed within each intake passage of the intake device. The throttle valve unit regulates an amount of the air or airflow to the combustion chambers in accordance with an angular position or open degree thereof. A throttle valve link 97 (FIG. 4) connects the respective throttle valves together with each other such that all the throttle valves simultaneously move. The throttle valve link 97 is connected to a throttle valve control grip or operating member 98 through a throttle valve control cable 100. The throttle valve link 97 is pivotally affixed to the handle bar 84. The control cable 100 preferably extends through an opening 102 (FIG. 4) formed at a front surface of the bottom cowling member 94 on the port side. The control grip 98 and the throttle valve control cable 100 will be described in greater detail below.

When the control grip 98 is operated by the operator, the control cable 100 actuates the throttle valve link 97 which moves the throttle valves between a substantially fully closed position and a fully open position. Unless the environmental circumstances change, an engine speed of the engine 88 increases generally along the increase of the air amount or airflow rate. In other words, the output of the engine 88 increases when the air amount or airflow rate increases.

A charge former such as, for example, a fuel injection system preferably supplies fuel to the combustion chambers to make air/fuel charges in the combustion chambers. A control device such as, for example, an electronic control unit (ECU) preferably controls an amount of the fuel such that an air/fuel ratio can be kept in the optimum state. The ECU preferably comprises a microprocessor which is a central processor unit (CPU), one or more storage or memory units, input and output units and an interface unit that connects those foregoing units. Control maps preferably are stored in the storage. The control maps can be used in the fuel amount control and other controls. Other charge formers such as, for example, carburetors can replace the fuel injection system.

A firing device having spark plugs exposed into the combustion chambers preferably ignites the air/fuel charges in the combustion chambers also under control of the ECU. Abrupt expansion of the volume of the air/fuel charges, which burn in the combustion chambers, moves the pistons to rotate the crankshaft.

An exhaust device routes exhaust gases in the combustion chambers to an external location of the outboard motor 50.

The exhaust valves are part of the exhaust device and allow the exhaust gases to exit the combustion chambers when the exhaust valves do not close exhaust ports of the combustion chambers. Majority of the exhaust gases preferably discharge to the water through exhaust sections defined within the housing unit 56.

A driveshaft 104 is coupled with the crankshaft and extends generally vertically through the housing unit 56. The housing unit 56 journals the driveshaft 104 for rotation and the crankshaft drives the driveshaft 104. The housing unit 56 also journals a propulsion shaft 106 for rotation. The propulsion shaft 106 extends generally horizontally through the lower unit 62. The driveshaft 104 and the propulsion shaft 106 are preferably oriented normal to each other (e.g., the rotation axis of the propulsion shaft 106 is at 90° to the rotation axis of the driveshaft 104).

The propulsion shaft 106 drives the propulsion device 68 through a transmission 108. In the illustrated arrangement, the propulsion device is a propeller 110 that is affixed to an outer end of the propulsion shaft 106. The propulsion device, however, can take the form of a dual, a counter-rotating system, a hydrodynamic jet, or any of a number of other suitable propulsion devices.

A shift mechanism 112 associated with the transmission 108 changes positions of the transmission 108. The propeller 110 varies among forward, reverse and neutral modes in accordance with the positions of the transmission 108. In the forward mode, the propeller 110 rotates in a direction that propels the watercraft 66 forwardly. In the reverse mode, the propeller 110 rotates in a reverse direction that propels the watercraft 66 backwardly. In the neutral mode, the propeller 110 does not rotate and does not propel the watercraft 66 either forwardly or backwardly.

The transmission 108 preferably comprises a drive pinion 116, a forward bevel gear 118 and a reverse bevel gear 120 to couple the two shafts 104, 106. The drive pinion 116 is disposed at the bottom end of the driveshaft 104. The forward and reverse bevel gears 118, 120 are disposed on the propulsion shaft 106 and spaced from each other. Both bevel gears 118, 120 mesh with the drive pinion 116. The bevel gears 118, 120, however, slide on the propulsion shaft 106 unless coupled with the propulsion shaft 106.

A dog clutch unit is slideably but not rotatably disposed between the forward and reverse bevel gears 118, 120 on the propulsion shaft 106 such that a clutch member selectively engages the forward bevel gear 118 or the reverse bevel gear 120 or does not engage any one of the forward and reverse bevel gears 118, 120. The forward bevel gear 118 or the reverse bevel gear 120 can be coupled with the propulsion shaft 106 when the clutch member engages the forward bevel gear 118 or the reverse bevel gear 120, respectively.

The shift mechanism 112 preferably includes a shift rod 122 that extends vertically through the steering shaft 46 and the lower portion of the housing unit 56. A top end of the shift rod 122 extends upward beyond the bottom cowling member 94. The shift rod 122 can pivot about an axis thereof. The shift rod 122 preferably has a shift cam at the bottom. The shift cam abuts a cam follower defined in a recessed front end of the dog clutch unit. The dog clutch unit thus follows the pivotal movement of the cam and the clutch member slides on the propulsion shaft 106 to engage either the forward or reverse bevel gear 118, 120 or not engage any one of the bevel gears 118, 120.

The transmission 108 is placed in a forward shift position corresponding to the forward mode of the propeller 110 when the clutch member engages the forward bevel gear 118. The transmission 108 is placed in a reverse shift position corresponding to the reverse mode of the propeller 110 when the clutch member 116 engages the reverse bevel gear 118. The transmission 108 is placed in a neutral position corresponding to the neutral mode of the propeller 110 when the clutch member 116 does not engage the forward bevel gear 118 nor the reverse bevel gear 120. Preferably, the neutral position is located between the forward and reverse positions.

A shift link 124 preferably is coupled with a top end of the shift rod 122. The shift link 124 is connected to a shift lever 126, which is swingably affixed to the handle bar 84, through a shift control cable 128. The control cable 128 extends through the opening 102 of the bottom cowling member 94. The shift lever 126 and the shift control cable 128 will be described in greater detail below.

With reference to FIGS. 3–7, the handle bar 84 is described below.

Figure 5:
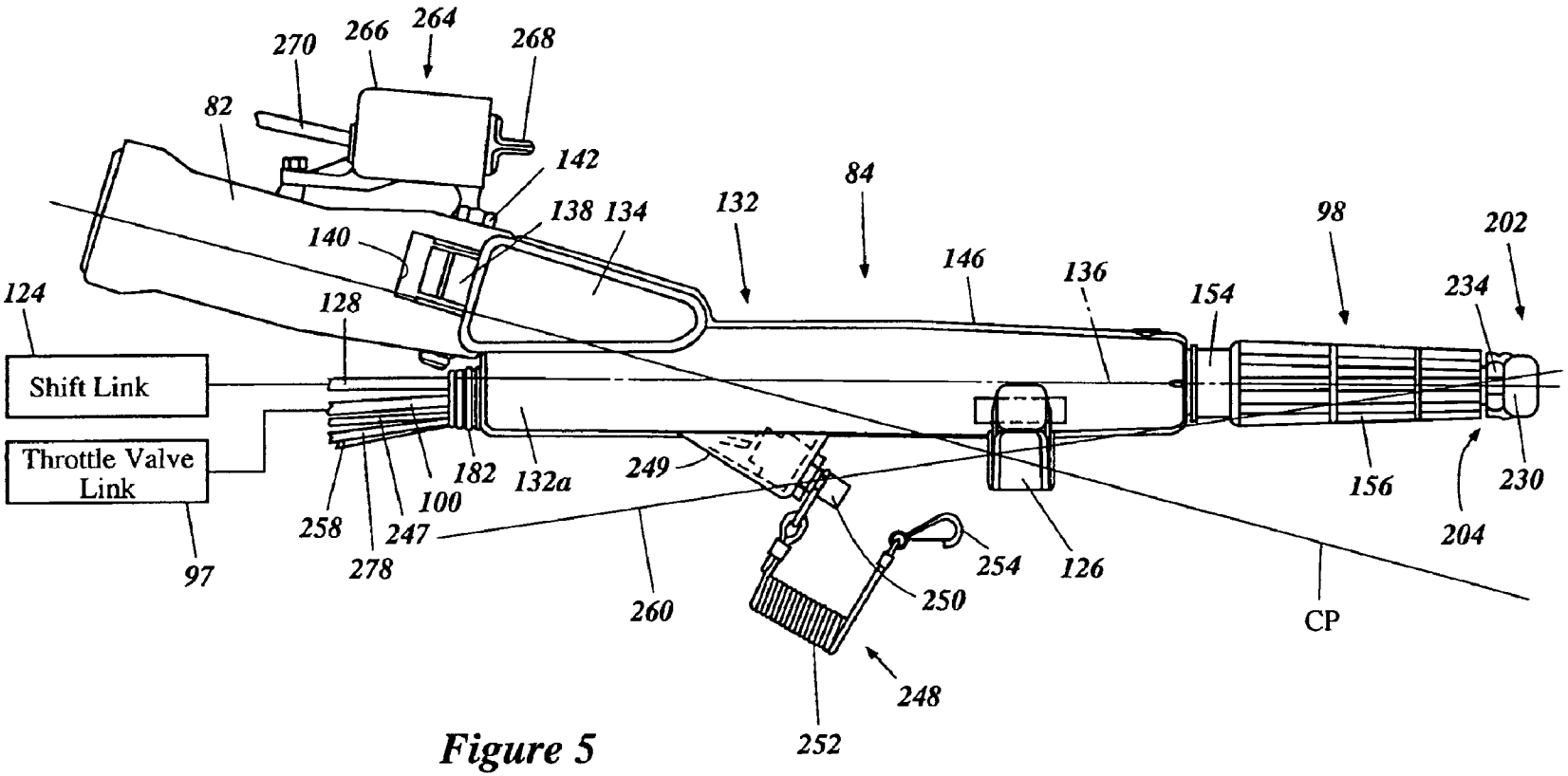
FIG. 5 illustrates an enlarged top plan view of the handle bar of FIG. 4.

With reference to FIGS. 3–5, the handle bar 84 is affixed to the forward end of the steering bracket 82 as noted above. The handle bar 84 has a longitudinal axis 136 (FIG. 5) that extends between front and rear ends of the handle bar 84. The handle bar 84 preferably comprises a housing 132 and a bracket portion 134. The housing 132 preferably comprises an upper housing member 132*a* and a lower housing member 132*b* both mated together. Preferably, the bracket portion 134 is unitarily formed with the housing 132 and thus comprises two members extending from the upper and lower housing members 132*a*, 132*b*. The bracket portion 134 extends generally backward from a rear end of the housing 132. The bracket portion 134 makes an acute angle relative to the housing 132 and is disposed at a side surface of the rear end portion of the housing 132 on the port side.

The bracket portion 134 has a projection 138 while the steering bracket 82 has a recess 140 at the forward end. The projection 138 is positioned within the recess 140 and defines an aperture. The steering bracket 82 also has apertures on both sides of the recess 140. A pivot shaft 142 extends through those apertures such that the handle bar 84 is affixed to the steering bracket 82 for pivotal movement about an axis of the pivot shaft 142. As shown in FIGS. 4 and 5, an axis of the steering bracket 82 extends on the center plane CP. Because the axis of the pivot shaft 142 extends normal to the axis of the steering bracket 82 and, as noted above, the bracket portion 134 makes the acute angle, the housing 132 is slightly inclined left such that the front end of the handle bar 84 is positioned on the port side and the rear end of the handle bar 84 (i.e., the rear end of the housing 132 in this context) is positioned on the starboard side both relative to the center plane CP.

The longitudinal axis of the housing 132 extends forward and slightly upward when the handle bar 84 is in use as shown in FIG. 3. Preferably, a limit member is attached to the pivot shaft 142 or the steering bracket 82 to prevent the handle bar 84 from moving downward further from the generally horizontal position of FIG. 3. Because the handle bar 84 is allowed to pivot upward, the handle bar 84 is collapsible toward the protective cowling 90 when the handle bar 84 is not in use.

The housing 132 preferably has a body portion 146 and a front portion 148 that extends forward from the body portion 146. The upper and lower housing members 132*a*, 132*b* together define a closed cavity 150 at the body portion 146. The cavity 150 has a relatively large volume. The upper and lower housing members 132*a*, 132*b* at the front portion 148 meet close with each other.

Figure 6:
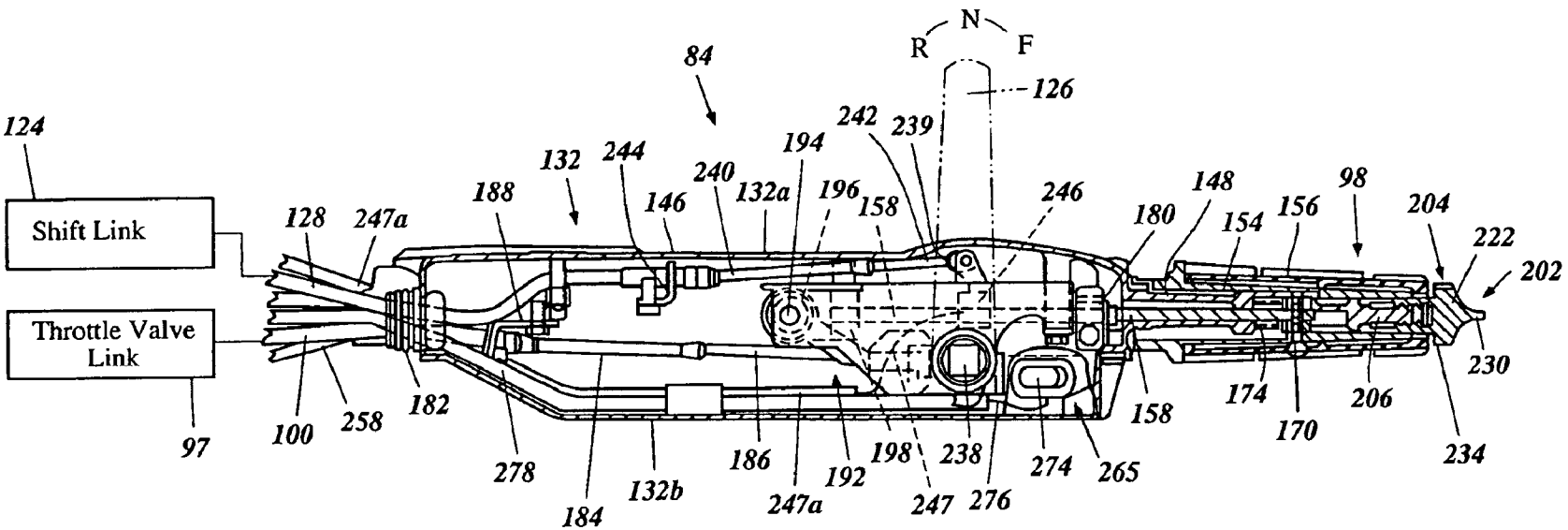
FIG. 6 illustrates a cross-sectional and side elevational view of the handle bar of FIG. 5.
Figure 7:
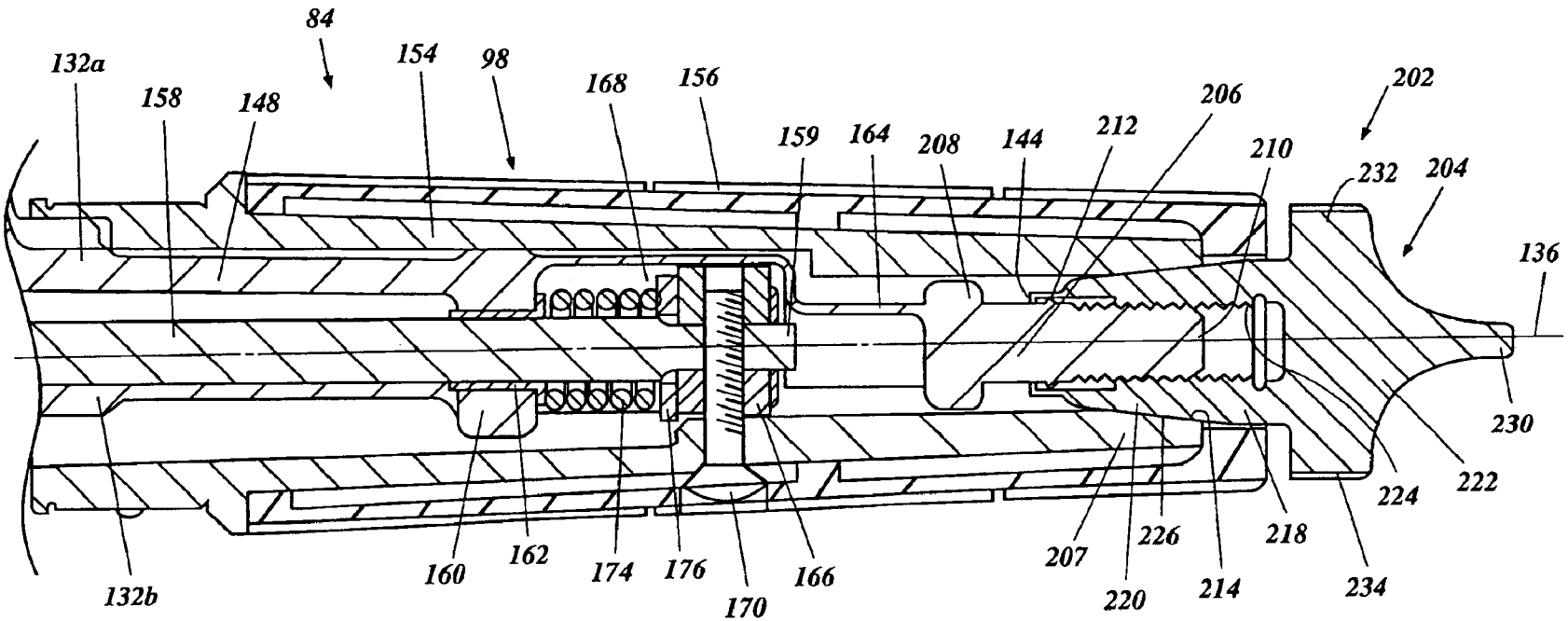
FIG. 7 illustrates an enlarged cross-sectional view of an end portion of the handle bar.
Figure 8:
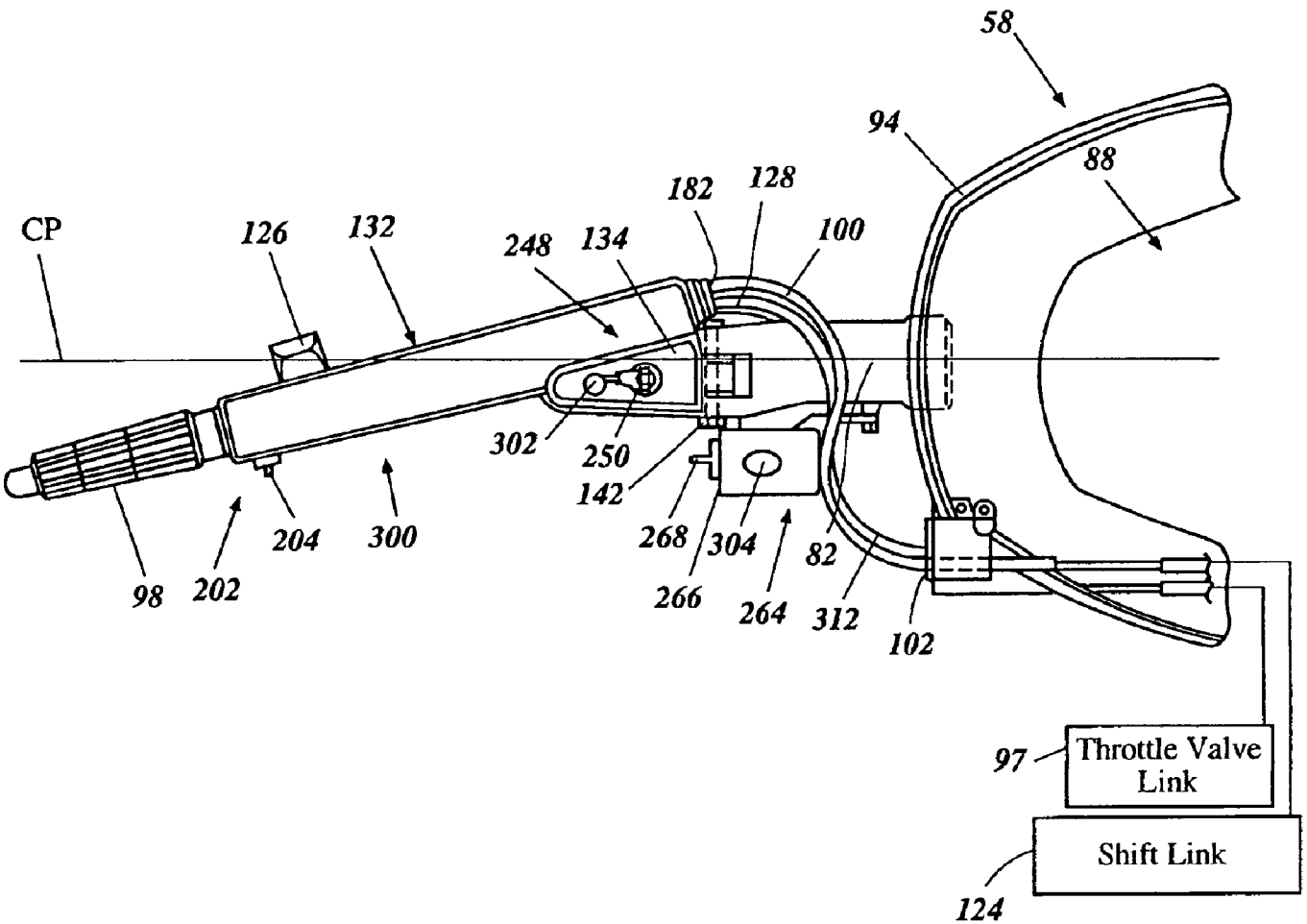
FIG. 8 illustrates a top plan view of another handle bar having a pilot lamp and a buzzer, the handle bar in this figure is not provided in accordance with the currently claimed invention.
Figure 9:
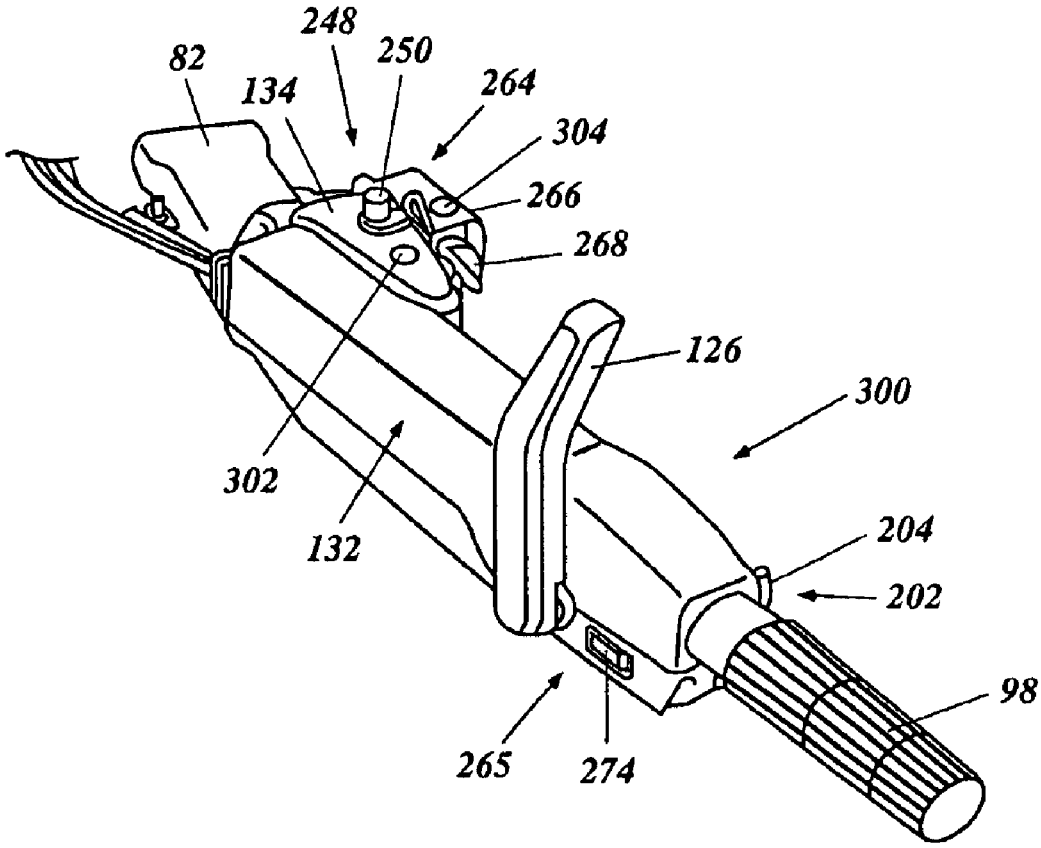
FIG. 9 illustrates a perspective view of the handle bar of FIG. 8.
Figure 10:
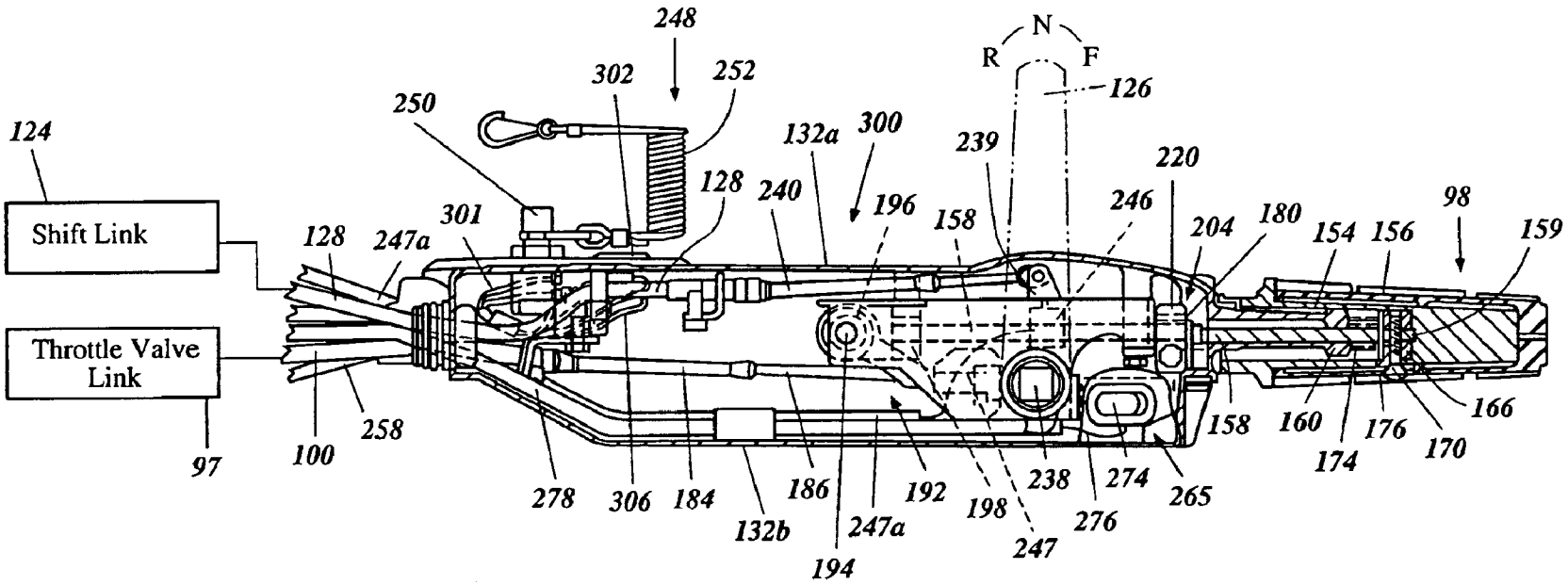
FIG. 10 illustrates a cross-sectional and side elevational view of the handle bar of FIG. 8.
Figure 11:
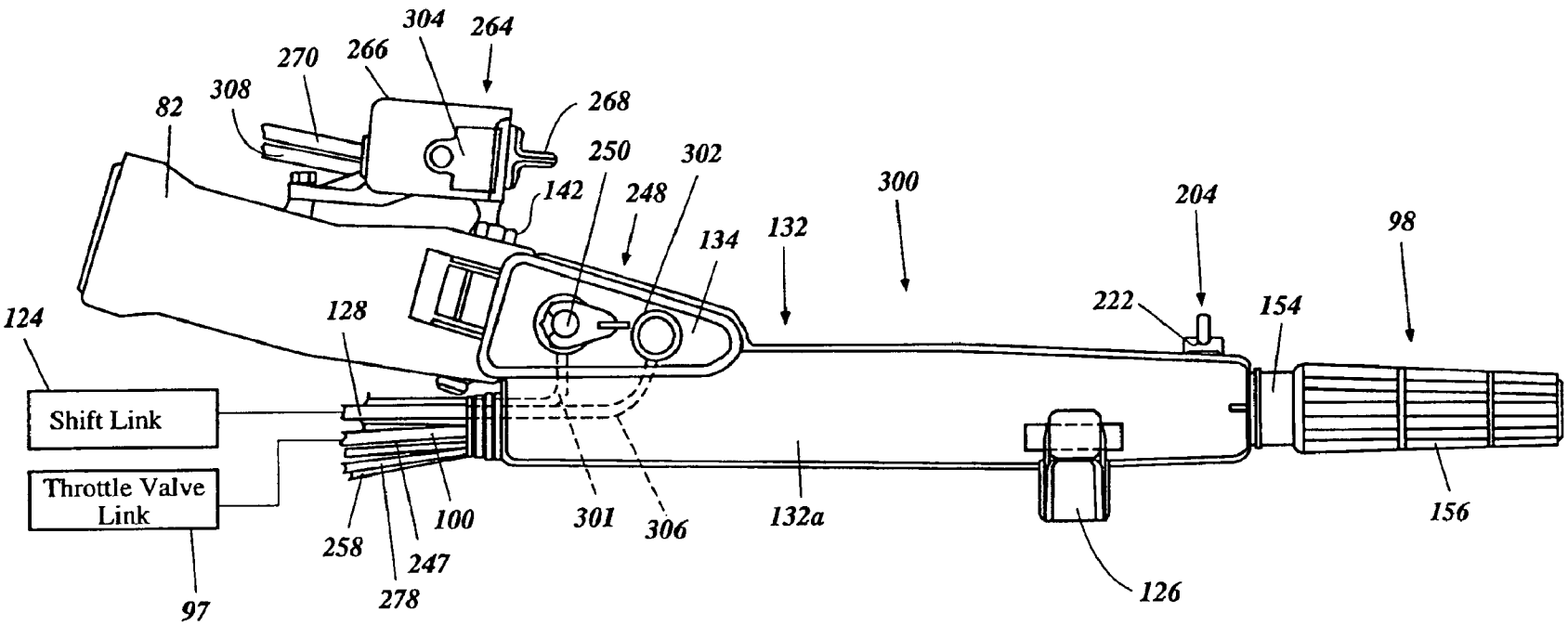
FIG. 11 is an enlarged top plan view of the handle bar of FIG. 8.

With reference to FIGS. 6 and 7, the throttle valve control grip 98 is disposed at the front portion 148 of the housing 132 for pivotal movement about the longitudinal axis 136 of the housing 132. The control grip 98 is generally configured as a cylindrical shape that is slightly tapered forward. The grip 98 preferably comprises a tubular base member 154 and a cover member 156 which also is shaped tubular. The cover member 156 preferably is made of a rubber material and is affixed onto the tubular member 154 to cover an outer surface of the tubular member 154. The control grip 98 is put onto the front portion 148 of the housing 132 such that the grip 98 is rotatable about the longitudinal axis 136.

A rotary shaft 158 extends through the housing 132 such that an axis of the rotary shaft preferably is coaxial with the longitudinal axis 136. The rotary shaft 158 is provided to control the throttle valve control cable 100. A front portion of the rotary shaft 158 extends within the front portion 148 of the housing 132 and ends generally halfway of the front portion 148, while a rear portion of the rotary shaft 158 extends within the body portion 146 and ends generally halfway of the body portion 146. The upper housing member 132*a* preferably is longer than the lower housing member 132*b*. The upper housing member 132*a* has a support portion 160 close to a terminal end 159 of the rotary shaft 158. The illustrated support portion 160 abuts the end of the lower housing member 132*b*. The support portion 160 journals the rotary shaft 158 via a collar 162 in the front portion 148 of the housing 132. The upper housing member 132*a* further extends forward and toward a front end of the control grip 98 to form an extending portion 164.

The terminal end 159 of the rotary shaft 158 fits into a joint member 166. The joint member 166 is in a space 168 defined by the extending portion 164 of the upper housing member 132*a*. The joint member 166 has a threaded aperture that has an axis extending generally normal to the longitudinal axis 136 of the handle bar 84. The rotary shaft 158 also has an opening corresponding to the threaded aperture. Further, an opening is made through a portion of the control grip 98 located corresponding to the aperture and the opening of the rotary shaft 158. A bolt 170 is fitted into the openings and the aperture so as to join the rotary shaft 158 with the control grip 98. The rotary shaft 158 thus can rotate about the longitudinal axis 136 while the operator rotates the control grip 98. The space 168 allows the joint member 166 to rotate therein.

A coil spring 174 preferably surrounds the rotary shaft 158 and extends between the collar 162 and a circular plate 176 that is attached to the joint member 166. The spring 174 urges the control grip 98 to separate from the housing members 132*a*, 132*b*. Actually, however, because the grip 98 is connected to the rotary shaft 158 that is rotatably affixed to the body portion 146 of the housing 132 (as described in detail below), the grip 98 does not slip off. The urging force of the spring 74 can make the operator's operation of the grip 98 easier. The spring 174 itself does not rotate by the friction produced between the spring 174 and the circular plate 176 and biases the rotary shaft 158 toward a direction in which the throttle valves are moved toward the fully closed position.

With reference to FIG. 6, the other terminal end of the rotary shaft 158 preferably is journaled by one or more support sections 180 formed inside of the body portion 146 of the housing 132. On the other hand, the throttle valve control cable 100 extends through a guide member 182 which is attached to an opening formed at the front end of the housing 132. The opening to which the guide member 182 is attached is located on the starboard side relative to the center plane CP.

The control cable 100 preferably is a push-pull cable that comprises an outer sheath 184 and an inner mechanical wire 186. The sheath 184 is affixed to a stay 188 that extends from an inner surface of the lower housing member 132*b*. The inner wire 186 thus can reciprocally move within the sheath 184. A throttle valve control transmission mechanism 192 is provided between the terminal end of the rotary shaft 158 and the inner wire 186 so as to connect the throttle valve control grip 98 to the throttle valve link 97.

The throttle valve control transmission mechanism 192 can be any one of proper conventional structures. The transmission mechanism 192 in the illustrated embodiment comprises a bevel gear connection. A middle shaft 194 preferably extends horizontally right in front of the rotary shaft 158. An axis of the middle shaft 194 extends normal to the axis of the rotary shaft 158. A support 196 journals the middle shaft 194 within the body portion 146 of the housing 132. A lever 198 is affixed onto the middle shaft 194 so as to pivot together with the middle shaft 194. A drive pinion is affixed to the end of the rotary shaft 158 while a bevel gear is affixed to the middle shaft 194 and meshes the drive pinion. The lever 198 is affixed to the inner wire 186 of the control cable 100. The middle shaft 194 rotates about its own axis through the drive pinion and the bevel gear when the rotary shaft 158 rotates. The inner wire 186 thus can move reciprocally within the sheath 184 while the lever 198, which is affixed to the middle shaft 194, pivots about the axis of the middle shaft 194.

With reference to FIGS. 6 and 7, the handle bar 84 has a lock mechanism 202 to lock the control grip 98 at a certain angular position. In other words, the lock mechanism 202 is provided to temporarily fix the rotary shaft 158 such that the throttle valves are kept at a certain position (i.e., certain open degree). The lock mechanism 202 preferably comprises a lock member 204 and additionally the upper housing member 123*a* and the control grip 98 together take part in the lock mechanism 202.

In the illustrated embodiment, a rear end of the control grip 98 located opposite to the housing 132 has an opening which axis extends generally along the longitudinal axis 136. The upper housing member 132*a* preferably extends to almost the front end of the handle bar 84 and forms a coupling portion 206 that couples with the lock member 204. A terminal end of the upper housing member 132*a* preferably is positioned on the same line as a terminal end of the tubular member 154.

An outer diameter of the coupling portion 206 is smaller than an inner diameter of an end portion 207 of the tubular member 154 and defines a space therebetween. A rear end of the coupling portion 206 preferably has an outer diameter that is almost the same as an inner diameter of the tubular member 154 and forms a large diameter section 208. The coupling portion 206 thus is held by the tubular member 154 and a center axis of the coupling portion 206 is kept to be generally consistent with the longitudinal axis 136 of the handle bar 84. Preferably, almost a half area of an outer surface of the coupling portion 206 from the terminal end thereof is threaded and forms a threaded surface 210. The illustrated coupling portion 206 has a circular projection 212 between the large diameter section 208 and the threaded surface 210. An inner surface 214 of the end portion 207 of the tubular member 154 is tapered rearward. That is, the inner diameter of the tubular member 154 at the end portion gradually becomes smaller than the terminal end of the tubular member 154.

The lock member 202 preferably comprises a coupling section 218, a lock section 220 and an operating section 222.

The coupling section 218 and the lock section 220 extend into the space formed between the coupling section 206 of the upper housing member 132*a* and the end portion 207 of the tubular member 154 through the foregoing opening of the rear end of the control grip 98. The operating section 222 remains outside of the control grip 98.

The illustrated lock member 202 has a recess 224, and an area defining the recess 224 forms the coupling section 218. The coupling section 218 preferably is threaded and can be screwed down to the threaded surface 210 of the coupling portion 206 of the upper housing member 132*a*. An outer surface 226 around the recess 224, which is the coupling section 218, is tapered rearward and forms the lock section 220. The inner surface 214 of the tubular member 154 and the outer surface 226 of the lock member 202 frictionally abut each other. More specifically, the lock section 220, which is the tapered outer surface 226, comes into the tapered inner surface 214 like a wedge when the lock member 204 is screwed up. Thus, the control grip 98 is locked and is prevented from rotating relative to the housing 132.

The operator can operate the lock member 204 by the operating section 222. The illustrated operating section 222 has a knob 230 with which the operator can rotate the lock member 204. A trunk portion 232 of the operating section 222 located next to the coupling section 218 and the lock section 220 (i.e., between the knob 230 and the inner part of the lock member 204) has a larger diameter than the other portions of the lock member 204. A peripheral surface of the trunk portion 232 has a plurality of grooves 234 that provide roughness to the surface. The grooves 234 extend generally along the longitudinal axis 136 of the handle bar 84. The operator thus can rotate the lock member 204 with the trunk portion 232 instead of the knob 230. The grooves 234 provide the operator with easiness in rotating the lock member 204.

Normally, the operator sits aside on the starboard side relative to the handle bar 84 and operates the throttle valve control grip 98 by his or her left hand. Because the lock member 204 is positioned at the terminal end of the handle bar 84 in the illustrated embodiment, the operator does not need to detach his or her hand from the control grip 98 to handle the lock member 204. More specifically, some of the fingers of the operator's left hand can reach the lock member 204 without twisting the wrist. Accordingly, the handle bar 84 in the illustrated embodiment can provide easiness for operating the lock mechanism 202 of the throttle valve control grip 98.

In addition, the contact area where the inner surface 214 of the tubular member 154 and the outer surface 226 of the coupling portion 206 of the housing 132 abut each other can be large enough. This is because the inner and outer surfaces 214, 226 generally extend along the longitudinal axis 136 of the handle bar 84. The friction thus can be large.

The lock member 204 preferably has a reduced diameter portion 144 at a distal end of the coupling section 218 (or lock section 220). The reduced diameter portion 144 together with the circular projection 212 of the coupling portion 206 of the housing 132 can prevent the lock member 204 from coming off while the lock member 204 is loose from the coupling portion 206 of the housing 132.

With reference to FIGS. 5 and 6, the shift lever 126 and the shift control cable 128 are now described below.

The shift lever 126 preferably is swingably affixed to a side surface of the body portion 146 of the housing 132. Preferably, the shift lever 126 is positioned on the starboard side. The lower housing member 132*b* preferably journals a swing shaft 238 of the shift lever 126. The shift lever 126 is swingable about an axis of the swing shaft 238. An internal lever 239 is affixed to the swing shaft 238 inside of the body portion 146 of the housing 132. The internal lever 239 also is swingable with the swing movement of the shift lever 126.

The shift control cable 128 extends through the guide member 182 attached to the opening formed at the front end of the housing 132 and goes to the shift mechanism 112 through the opening 102 of the bottom cowling member 94. The control cable 182 preferably is a push-pull cable that comprises an outer sheath 240 and an inner mechanical wire 242. The sheath 240 is affixed to a stay 244 that extends from an inner surface of the upper housing member 132*a*. The inner wire 240 thus can reciprocally move within the sheath 240. The inner wire 240 is connected to the internal lever 239. The inner wire 242 can move while the operator operates the shift lever 126.

The shift lever 126 can swing between a fully forward position F and a fully rearward position R. The shift control cable 128 rotates the shift rod 122 of the shift mechanism 112 with the swing movement of the shift lever 126. The shift lever 126 takes a neutral position N that brings the propeller 110 to the neutral mode through the shift mechanism 112. The neutral position N of the shift lever 126 is located midway between the fully forward and fully reverse positions F, R. The shift lever 126 in the neutral position N extends generally vertically as shown in FIG. 6. In other words, the shift lever 126 extends generally normal to the longitudinal axis 136 when the shift lever 126 is in the neutral position. On the way to the fully forward position F from the neutral position N, the propeller 110 is shifted to the forward mode. Also, on the way to the fully rearward position R from the neutral position N, the propeller 110 is shifted to the reverse mode.

A neutral position sensor 246 is disposed close to the internal lever 239 inside of the housing 132 to sense that the shift lever 126 is placed at the neutral position. A wire or signal line 247 is connected to the ECU through the guide member 182. A cover member 247*a* covers the wire 247. The ECU controls the actuator (i.e., electric motor) of the tilt and trim adjustment device. A neutral signal sent to the ECU is used to control the engine operation. For example, the ECU can allow the engine 88 to start only when the neutral signal indicates that the shift lever 126 is in the neutral position.

With reference to FIGS. 4 and 5, a stop switch assembly 248 also is disposed on the side surface of the body portion 146 of the housing 132 where the shift lever 126 is affixed. The stop switch assembly 248 can be used to stop the engine operation in certain emergency situations.

The stop switch assembly 248 comprises an electrical switch unit, a switching member 250 and a lanyard 252. In the illustrated embodiment, a pedestal 249 extends from the side surface of the body portion 146. The pedestal 249 is generally configured as a triangular prism. The switching member 250 extends from a forwardly positioned surface of the triangular prism such that an axis of the switching member 250 makes an acute angle with the longitudinal axis 136 of the handle bar 84. The major part of the switch unit is disposed within the pedestal 249. The switch unit is connected to the ECU and works to stop the engine operation when the switching member 250 is out of a retained position. One end of the lanyard 252 is inserted below the switching member 250 to keep the switching member 250 in the retained position. Normally, the lanyard 252 is wound up (i.e., retracted). The other end of the lanyard 252 has a ringed portion or hook 254 that is attached to the operator's wrist, wear or something like that.

A wire or signal line 258 connects the switch unit of the stop switch assembly 248 to the ECU. The wire 258 extends through the guide member 182 and goes to the engine 88 through the opening 102 of the bottom cowling member 94.

In the event that the operator falls into the water, the lanyard 252 is extending and the inserted end of the lanyard 252 comes off from the switching member 250 when the lanyard 252 fully extends. The switching member 250 thus is out of the retained position and the switch unit sends a stop signal to the ECU. The ECU thus stops the engine operation based upon the stop signal. For example, the ECU disables the firing device from igniting the air/fuel charges or disables the fuel injection system from injecting fuel. The operator can simply push the switching member 250 to activate the switch unit even though the lanyard 252 keeps the switching member 250 in the retained position.

With reference to FIG. 5, in the illustrated embodiment, the operating section 222 of the lock member 204, the throttle valve control grip 98, the shift lever 126 and the switching member 250 of the stop switch assembly 248 generally align on a straight line 260 in this order. The stop switch assembly 248 is placed at the most rearward position in those components. The operating section 222 of the lock member 204, the throttle valve control grip 98, the shift lever 126 and the switching member 250 of the stop switch assembly 248 are not necessarily aligned on a straight line in a side elevational view.

The arrangement on the straight line 260 is advantageous because the operator can easily operate the lock member 204, the throttle valve control grip 98, the shift lever 126 and the stop switch assembly 248 with a minimum movement of his or her hand.

As noted above, the operator normally sits aside on the starboard side relative to the handle bar 84 and operates the throttle valve control grip 98 and the shift lever 126 by his or her left hand. Also, the operator normally puts on the lanyard 252 on his or her left wrist. Because the stop switch assembly 248 is affixed to the side surface of the housing 132 on the starboard side and is placed at the most rearward position relative to the control grip 98 and the shift lever 126, the lanyard 252 cannot become entangled with the control grip 98 or the shift lever 126. Thus, the arrangement of the stop switch 248 in connection with the control grip 98 and the shift lever 126 can contribute to the easy operation of the outboard motor 30.

Other switches or operating devices can be equipped on the handle bar 98 or the steering bracket 82. For example, a power switch assembly 264 is disposed on the steering bracket 82 in the illustrated embodiment and a power tilt and trim switch assembly 265 is disposed on the handle bar 98 in the illustrated embodiment.

With reference to FIG. 5, the power switch assembly 264, when turned on, can allow power source such as, for example, one or more batteries to supply electric power to electrical components in the outboard motor 30 and/or electrical equipment on the watercraft 66. The illustrated power switch assembly 264 comprises a housing 266, an electrical switch unit housed in the housing 266 and a switching member 268 ratably affixed to a front surface of the housing 266. The switch unit is connected to the electrical components and/or electrical equipment through a wire or power line 270. The switch unit is turned on when the operator rotates the switching member 268. The housing 266 preferably has a bracket portion unitarily formed with the housing 266. The bracket portion of the housing 266 is affixed to a side surface of the steering bracket 82 on the port side such that the power switch assembly 264 extends along the side surface of the steering bracket 82.

With reference to FIG. 6, the power tilt and trim switch assembly 265 preferably provides a switch function and an operating function. The switch function is to change a trim control mode between a manual trim control mode and an automatic trim control mode and vice versa. The operating function is to provide the ECU with a control command regarding either a trim up movement or a trim down movement and another control command regarding an angular degree amount of the trim movement.

Preferably, the trim switch assembly 265 is affixed to the body portion 146 of the housing 132 and comprises an electrical switch unit and a switching member 274 that changes its physical positions to bring the switch unit into the switch function and the operating function. A wire or signal line 276 connects the switch unit to the ECU through the guide member 182. A cover member 278 covers the wire 276. The ECU controls the actuator (i.e., electric motor) of the tilt and trim adjustment device.

The switching member 274 moves reciprocally along a horizontal axis that extends laterally relative to the body portion 146 when the operator pushes a center of the switching member 274 to realize the switch function. The switching member 274 preferably has two stable positions at both ends of the reciprocal movement. The stable positions alternately and electrically set the switch unit to a manual trim control state and an automatic trim control state whenever the operator pushes the switching member 274. Initially, the switch unit is in the manual trim control state.

The switching member 274 also swings about a vertical axis that extends a center of the switching member 274 when the operator pushes either end of the switching member 274 to realize the operating function. The swing movement of the switching member 274 is a flip-flop movement. When the operator pushes one of the switch ends, a trim up command is provided to the ECU. When the operator pushes the other switch end, a trim down command is provided to the ECU. Also, an amount of the flip-flop movement of the switching member 274 provides the ECU with the angular amount of the trim up or trim down movement of the drive unit 52. Preferably, the flip-flop movement of the switching member 274 coercively makes the switch unit send the manual trim control command to the ECU.

The power tilt and trim switch assembly can be used to manually control the tilt and trim adjustment device in the tilt range.

With reference to FIGS. 8–13, another handle bar 300, which is not an embodiment of the currently claimed invention though, is described below. The same devices, components, members and other related things which have been already described above will be assigned with the same reference numerals and will not be repeatedly described.

With reference to FIGS. 8–11, the lock member 204 of the lock mechanism 202 in this arrangement is affixed to the side surface of the handle bar housing 132 on the port side as arranged in conventional handle bars. Also, the stop switch assembly 248 in this arrangement is disposed on the top surface of the bracket portion 134. A wire or signal line 301 connects the switch unit of the stop switch assembly 248 and the ECU with each other. The wire 301 preferably is covered with a cover member. Other components and members such as, for example, the shift lever 126, the neutral position sensor 246, the power switch assembly 264 and the power tilt and trim switch assembly 265 are disposed at the same locations on the handle bar 84 as those in the arrangement described above. Of course, the lock mechanism 202 and the stop switch assembly 248 can be furnished at the same locations as those of the handle bar 84.

The handle bar 300 additionally has a buzzer 302 and a pilot lamp 304. The buzzer 302 is disposed next to the switching member 250 of the stop switch assembly 248 on the top surface of the bracket portion 134. The buzzer 302 is connected to the ECU through a wire or signal line 306 in this arrangement. The wire 306 preferably is covered with a cover member. The ECU makes the buzzer 302 sound when one or more abnormal conditions occur with the engine 88. The pilot lamp 304 is disposed on the top surface of the power switch housing 266. The pilot lamp 304 is also connected to the ECU through a wire or signal line 308. The ECU illuminates the pilot lamp 304 whenever the engine 88 normally operates.

Figure 12:
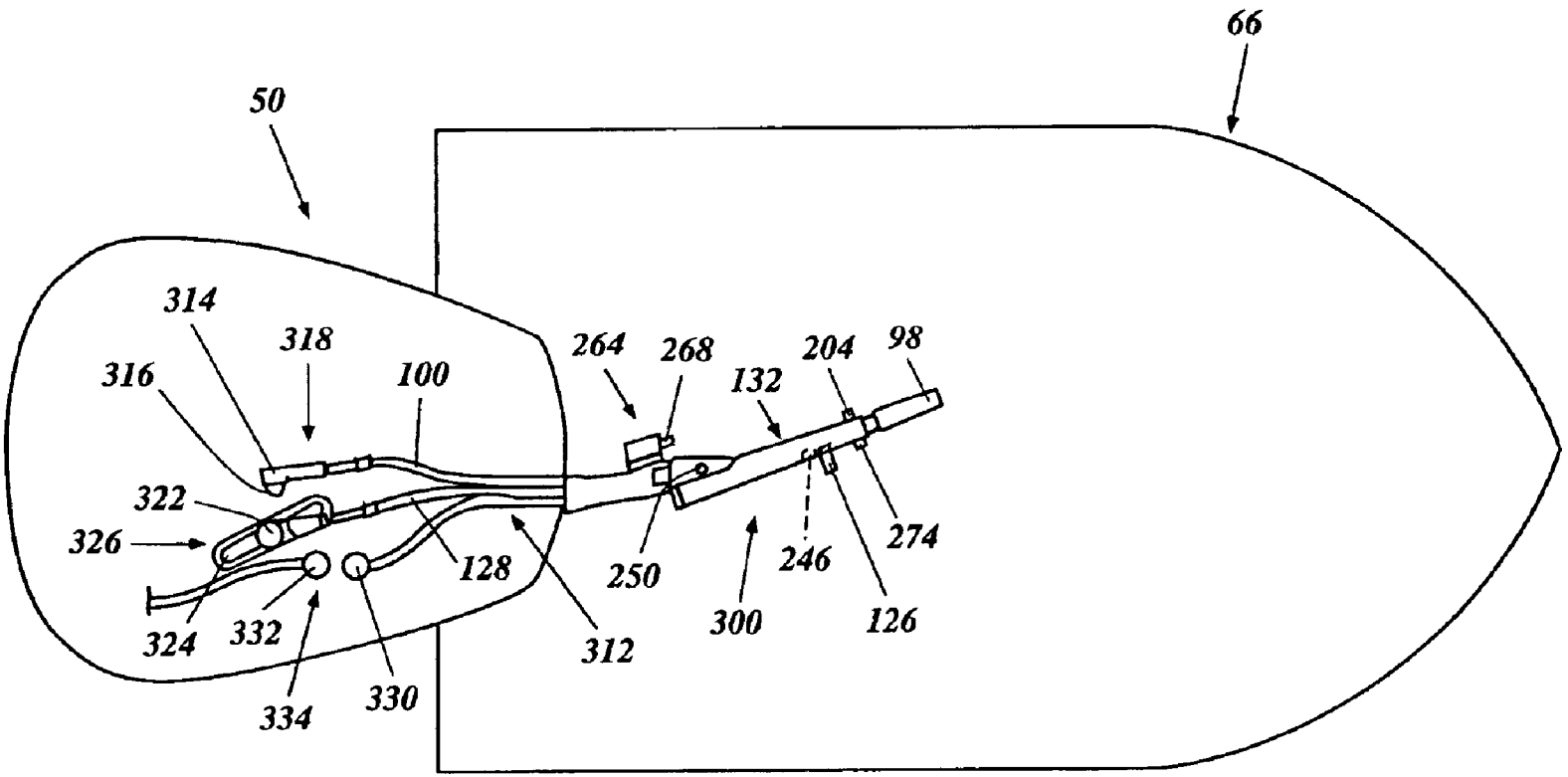
FIG. 12 is a schematic top plan view of a watercraft and an outboard motor that is equipped with the handle bar of FIG. 8.

With reference to FIG. 12, the wires 247, 270, 276, 301, 306, 308 are tied up with each other and forms a bunch of wire harness 312. The throttle valve control cable 100, the shift control cable 128 and the wire harness 312 extend from the handle bar 300 toward different portions of the outboard motor 50 where the respective control cables 100, 128 and the wire harness 312 are connected.

The throttle valve control cable 100 has a mechanical connector 314 at the end thereof. The mechanical connector 314 is detachably connected to a mechanical connector 316 that is disposed on the throttle valve link 97. The mechanical connectors 314, 316 together form a mechanical coupling 318. Also, the shift control cable 128 has a mechanical connector 322 at the end thereof. The mechanical connector 322 is detachably connected to a mechanical connector 324 that is disposed on the shift link 124. The mechanical connectors 322, 324 together form a mechanical coupling 326. Further, the wire harness 312 has an electric coupler 330 at the end thereof. The electric coupler 330 is detachably coupled with an electric coupler 332 disposed around the engine 88. The electric coupler 332 is connected to the ECU and/or other electrical components related to the wires 247, 270, 276, 301, 306, 308. The electric couplers 330, 332 together form an electrical coupling 334.

Figure 13:
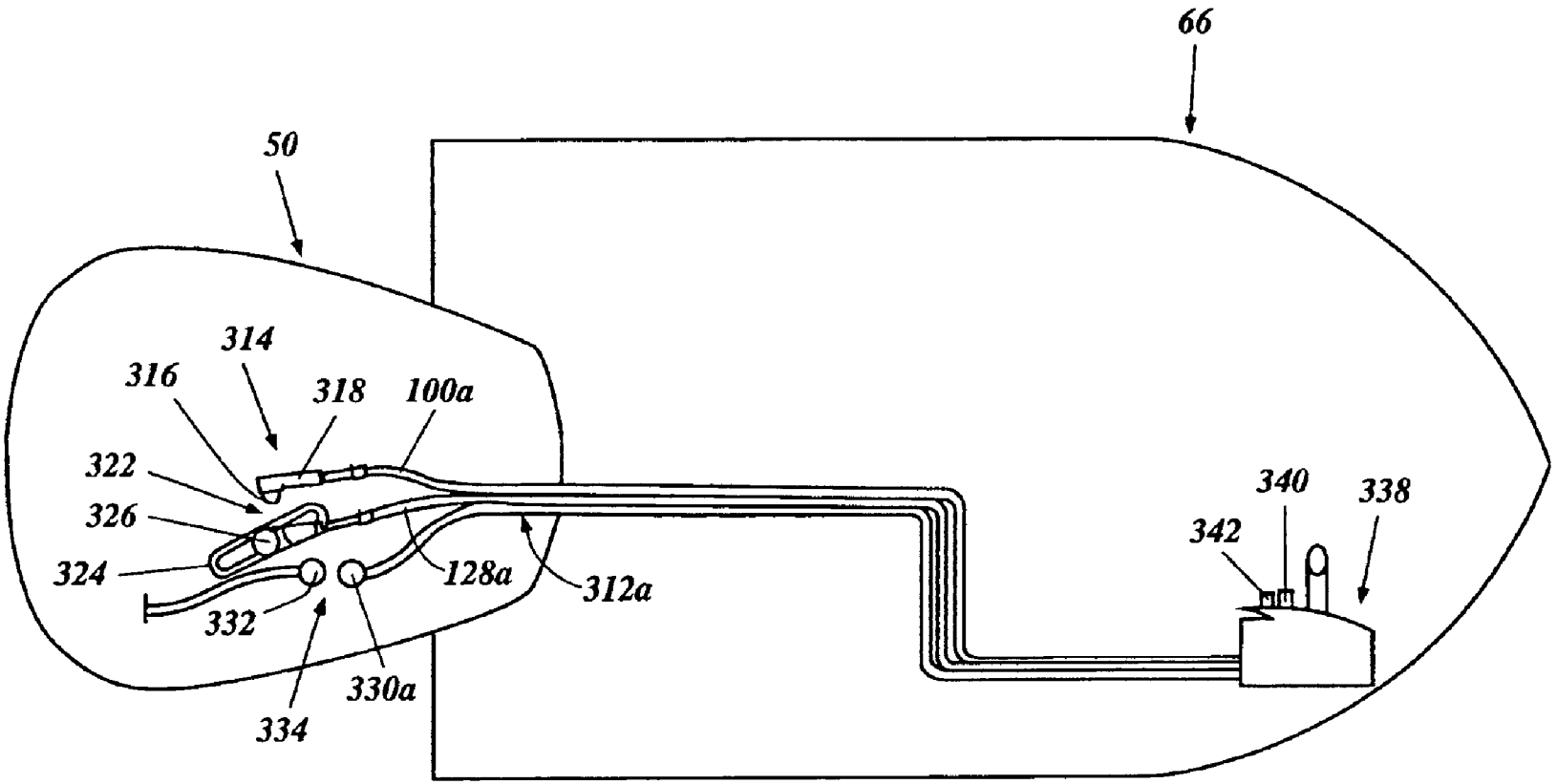
FIG. 13 is a schematic top plan view of the watercraft and the outboard motor of FIG. 12, the watercraft having a remote controller that is exchageable with the handle bar of FIG. 8.

With reference to FIG. 13, a conventional remote controller 338 can be employed for controlling the throttle valves, shift mechanism 112 and electrical components of the outboard motor 50. The remote controller 338 can have a throttle valve control cable 100A, a shift control cable 128A and a wire harness 312A corresponding to the throttle valve control cable 100, the shift control cable 128 and the wire harness 312 of the handle bar 300, respectively. The remote controller 338 also has the same buzzer and the same pilot lamp as the buzzer 302 and the pilot lamp 304 disposed on the handle bar 300. The buzzer and the pilot lamp of the remote controller 338 are symbolically indicated by a single reference numeral 340 of FIG. 13. Also, the remote controller 338 has the same neutral position sensor, power switch assembly, power tilt and trim switch assembly and stop switch assembly as the neutral position sensor 246, stop switch assembly 248, power switch assembly 264 and power tilt and trim switch assembly 265 disposed on the handle bar 300. The neutral position sensor, power switch assembly, power tilt and trim switch assembly and stop switch assembly of the remote controller 338 are symbolically indicated by a single reference numeral 342 of FIG. 13.

With reference to FIGS. 12 and 13, the mechanical couplings 318, 326 and the electrical coupling 334 of the handle bar 300 can be used for connecting the throttle valve control cable 100, the shift control cable 128 and the wire harness 312 to the respective portions of the outboard motor 50 without changing any structures from those of the conventional remote controller 338 and without adding any components and/or members to those of the remote controller 338. In other words, the illustrated handle bar 300 is exchangeable with the remote controller 338 because of using the same mechanical couplings 318, 326 and the electrical coupling 334.

As thus constructed, the handle bar 300 and the remote controller 338 can be quite easily exchanged from one to another in accordance with preference of the user. Particularly, the single coupler 330, 330 of the wire harness 312, 312A can contribute to easy connection with the coupler 332 of the engine side and to saving time in exchange work. Preferably, the couplers 330, 330A, 332, 332A are ten-pin couplers that have ten connecting pins.

Although this invention has been disclosed in the context of a certain preferred embodiment, it will be understood by those skilled in the art that the present invention extends beyond the specifically disclosed embodiment to other alternative embodiments and/or uses of the invention and obvious modifications and equivalents thereof. It is also contemplated that various combinations or sub-combinations of the specific features and aspects of the embodiments may be made and still fall within the scope of the invention. It should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. An outboard motor comprising a drive unit and a bracket assembly adapted to be mounted on an associated watercraft to carry the drive unit, the drive unit comprising a steering shaft supported by the bracket assembly for pivotal movement about a steering axis that extends generally vertically, a prime mover, a regulating device configured to regulate output of the prime mover, and a handle bar extending from the steering shaft, the handle bar comprising an operating member disposed at an end portion of the handle bar for pivotal movement about an axis of the handle bar, the operating member connected to the regulating device to operate the regulating device, and a lock mechanism arranged to inhibit the operating member from rotating, the lock mechanism positioned at a terminal end of the end portion.

2. The outboard motor as set forth in claim 1, wherein the lock mechanism at least in part is movable generally along the axis of the handle bar.

3. The outboard motor as set forth in claim 1, wherein the handle bar additionally comprises a housing in which a connecting member at least in part extends for connecting the operating member and the regulating device with each other, the lock mechanism provides frictional lock between the housing and the operating member.

4. The outboard motor as set forth in claim 3, wherein the operating member is a grip configured to cover a portion of the housing, the connecting member is coupled with the grip.

5. The outboard motor as set forth in claim 1, wherein the handle bar additionally comprises a housing in which a connecting member at least in part extends for connecting the operating member and the regulating device with each other, the lock mechanism comprises a lock member at least in part interposed between the housing and the operating member.

6. The outboard motor as set forth in claim 5, wherein an inner surface of the operating member at least in part is tapered, an outer surface of the lock member at least in part is tapered to fit into the operating member, the inner surface of the operating member and the outer surface of the lock member frictionally abut each other.

7. The outboard motor as set forth in claim 5, wherein the lock member has an outer portion extending out of the housing and the operating member.

8. The outboard motor as set forth in claim 7, wherein the outer portion of the lock member at least in part is configured as a knob shape.

9. The outboard motor as set forth in claim 7, wherein the outer portion of the lock member at least in part has roughness on a peripheral surface of the outer portion of the lock member.

10. The outboard motor as set forth in claim 9, wherein a plurality of grooves make the roughness, the grooves extend generally along the axis of the handle bar.

11. The outboard motor as set forth in claim 5, wherein the lock member has a recess, a portion of the housing is fitted into the recess.

12. The outboard motor as set forth in claim 11, an inner surface of the recess at least in part is threaded, an outer surface of the portion of the housing is threaded, the portion of the housing is screwed into the recess.

13. The outboard motor as set forth in claim 5, wherein the lock member is movable generally along the axis of the handle bar.

14. The outboard motor as set forth in claim 1, wherein the prime mover is an internal combustion engine, the regulating device is a throttle valve that regulates an amount of air delivered to a combustion chamber of the engine.

15. The outboard motor as set forth in claim 14 additionally comprising a propulsion device arranged to propel the outboard motor, a transmission including a shift mechanism arranged to change the propulsion device at least between first and second modes, a shift lever pivotally disposed on the handle bar and connected to the shift mechanism, and a stop switch assembly configured to stop an operation of the engine and disposed on the handle bar, the lock mechanism having a lock member arranged to operate the lock mechanism, and the shift lever, the stop switch assembly and the lock member generally aligning with each other.

16. The outboard motor as set forth in claim 15, wherein the stop switch assembly is placed at the most rearward position.

17. The outboard motor as set forth in claim 16, wherein the shift lever and the stop switch assembly are disposed on a side surface of the handle bar.

18. The outboard motor as set forth in claim 17, wherein the shift lever and the stop switch assembly are positioned on the starboard side of the outboard motor.

19. The outboard motor as set forth in claim 16, wherein the stop switch assembly includes a lanyard.

20. An outboard motor comprising a drive unit and a bracket assembly adapted to be mounted on an associated watercraft to carry the drive unit, the drive unit comprising a steering shaft supported by the bracket assembly for pivotal movement about a steering axis that extends generally vertically, a prime mover, a regulating device configured to regulate output of the prime mover, and a handle bar extending from the steering shaft, the handle bar comprising an operating member disposed at an end portion of the handle bar for pivotal movement about an axis of the handle bar, the operating member connected to the regulating device to operate the regulating device, and a lock unit arranged to provide friction between the housing and the operating member, the lock unit including a lock member disposed at a terminal end of the end portion.

21. An outboard motor comprising a drive unit and a bracket assembly adapted to be mounted on an associated watercraft to carry the drive unit, the drive unit comprising a steering shaft supported by the bracket assembly for pivotal movement about a steering axis that extends generally vertically, a prime mover, a regulating device configured to regulate output of the prime mover, and a handle bar extending from the steering shaft, the handle bar comprising an operating member disposed at an end portion of the handle bar for pivotal movement about an axis of the handle bar, the operating member connected to the regulating device to operate the regulating device, and means for inhibiting the operating member from rotating and disposed at a terminal end of the end portion.

22. A method for controlling an outboard motor that has a drive unit including a prime mover, comprising regulating output of the prime mover by an operating member that is disposed at an end portion of a handle bar, and inhibiting the operating member from rotating by a lock mechanism that is disposed at a terminal end of the end portion while not regulating output of the prime mover.

* * * * *